United States Patent [19]

Burkleca

[11] Patent Number: 4,514,921

[45] Date of Patent: May 7, 1985

[54] FIREARM RECOIL BUFFER

[76] Inventor: Frank M. Burkleca, 5947 Library Rd., Bethel Park, Pa. 15102

[21] Appl. No.: 464,642

[22] Filed: Feb. 7, 1983

[51] Int. Cl.[3] ..... F41C 27/00; F41C 21/18

[52] U.S. Cl. ..... 42/1 V

[58] Field of Search ..... 42/1 V, 74, 71 R; 89/198

[56] References Cited

U.S. PATENT DOCUMENTS

| | | | |
|---|---|---|---|
| 2,679,192 | 5/1954 | Seeley et al. | 42/1 V |
| 3,115,063 | 12/1963 | Browning | 42/1 V |
| 3,580,132 | 5/1971 | Vartanian | 42/1 V |
| 3,650,060 | 3/1972 | Schubert | 42/1 V |
| 3,683,534 | 8/1972 | Davis | 42/1 V |
| 4,088,057 | 5/1978 | Nasypany | 42/1 V |
| 4,156,979 | 6/1979 | Katsenes | 42/1 V |
| 4,164,825 | 8/1979 | Hutchison | 42/1 V |

*Primary Examiner*—Charles T. Jordan

*Attorney, Agent, or Firm*—Stanley J. Price, Jr.; John M. Adams

[57] ABSTRACT

A firearm, such as a pump action shotgun, includes a barrel connected by a magazine cap to a receiver. A fore end assembly is connected to the receiver and includes a magazine tube positioned below the barrel. A tubular recoil buffer surrounds the magazine tube, and a slide bar arrangement extending from the recoil buffer connects the recoil buffer to the receiver. A cup-shaped fore end is adapted to receive the recoil buffer and is preferably fabricated of a light weight material, such as aluminum or plastic. The fore end has an internal shoulder, and a compression spring is positioned in the fore end in surrounding relation with the recoil buffer. The coil spring has opposite end portions and one end portion abuts the fore end shoulder and the opposite end abuts a spanner nut. The spanner nut is threadedly connected to the end of the recoil buffer. The spanner nut is advanced to a predetermined position on the recoil buffer to apply a preselected degree of compression to the coil spring where the coil spring is compressed between the fore end and the spanner nut. With this arrangement, the fore end receives a biasing force from the coil spring. The shooter's hand supports the fore end to thereby exert an inertia force on the fore end maintaining the fore end normally stationary. When the firearm is discharged, the rearward or recoil force generated by the firearm is transmitted to the shooter's hand and is dampened by the inertia force of the fore end which moves forwardly to compress the coil spring and thereby absorb the recoil shock to the extent that the impact transmitted to the shooter's shoulder is negligible.

15 Claims, 10 Drawing Figures

FIREARM RECOIL BUFFER

BACKGROUND OF THE INVENTION

1. Field of the Invention

This invention relates to a firearm recoil reducing device and more particularly to a movable fore end of a firearm in which a compression spring abuts the fore end which is held by the shooter's hand and move rearwadly against the compression spring to reduce the recoil action when the firearm is discharged.

2. Description of the Prior Art

Recoil devices for firearms, such as rifles and shotguns, are well known in the art as disclosed in U.S. Pat. Nos. 2,679,192; 3,115,063; 3,683,534; 4,088,057 and 4,156,979. U.S. Pat. No. 2,679,192 discloses a piston which is forwardly driven by the gas generated by the cartridge explosion in a tube against the spring. The mass of the forwardly moving piston tends to drive the entire gun assembly forwardly in the direction opposite the recoil on the firer's shoulder.

U.S. Pat. No. 4,156,979 discloses a take-off saddle through which the explosive gas is directed upon an inertia weight which is moved forwardly against a buffer spring. The spring compresses and the energy released by the spring subtracts from the recoil. In U.S. Pat. No. 3,115,063, male and female ring members are positioned in the magazine tube of the firearm. The ring members are compressible both longitudinally and radially. The relative expansion and contraction of the rings creates a high frictional resistance to dissipate the recoil energy.

It is also known, as disclosed in U.S. Pat. No. 3,650,060, to utilize a heavy metal piston positioned against a foam rubber cushion in a magazine follower that engages the shells. The magazine spring is secured to the outer end of the piston and equal pressure is applied to the piston. U.S. Pat. No. 4,088,057 includes a movable inertia weight positioned in a cylinder mounted on the firearm. The gas generated by the cartridge explosion is confined between the weight and a fixed seal ring attached to the gun. The rearward force generated by the gas pressure is dampened by the piston. The gas pressure is also utilized to exert a force on the fixed seal ring to move the gun forwardly from the shooter's shoulder.

While it has been suggested by the prior art devices to utilize recoil buffers to reduce the shock applied to the shooter's shoulder when the firearm is discharged, the known devices generally require substantial change and alteration to the magazine and are not relatively adaptable to both pump action and single action shotguns. Therefore, there is need for a recoil buffer associated with the conventional fore end of a firearm and readily adaptable to both pump action and single action shotguns without requiring major modification to the shotgun and without increasing the weight of the fore end.

SUMMARY OF THE INVENTION

In accordance with the present invention, there is provided a firearm recoil reducing device that includes a receiver and a fore end member positioned forwardly of the receiver. Means is provided for connecting the fore end member to the receiver. A movable fore end is adapted to receive the fore end member. The movable fore end has an internal shoulder. A compression coil spring is positioned in the movable fore end in surrounding relation with the fore end member. The coil spring has a first end and a second end. The coil spring first end abuts the fore end internal shoulder. A spanner nut is releasably engagable with the end of the fore end member adjacent the coil spring second end portion. The spanner nut is movable to a predetermined position on the fore end member to compress the coil spring on the fore end member between the fore end internal shoulder and the spanner nut such that when the firearm is discharged, the fore end remains stationary against the compression of the coil spring and the coil spring compresses further to reduce the recoil force directed toward the receiver.

Accordingly, the principal object of the present invention is to provide a firearm recoil reducing device that is readily adapted to a variety of firearms, such as pump action and single action shotguns for reducing the recoil shock when the firearm is discharged without requiring major modifications to the firearm and without increasing the weight of the fore end, which is supported by the shooter's hand.

Another object of the present invention is to provide an inertia type recoil reducing device for a shotgun, both pump action and single action, which is operable to buffer the recoil action by application of the firer's weight to the fore end when the fore end is supported in the shooter's hand.

A further object of the present invention is to provide, for both pump action and single action shotguns, a recoil buffer that replaces the original fore end and is fabricated of a lightweight material adapted to surround the magazine tube beneath the gun barrel and is operable to act as a shock absorber where the recoil force is transmitted by the buffer to the shooter's hand at the fore end.

These and other objects of the present invention will be more completely disclosed and described in the following specification, the accompanying drawings and the appended claims.

DESCRIPTION OF THE PREFERRED EMBODIMENTS

Figure 1:
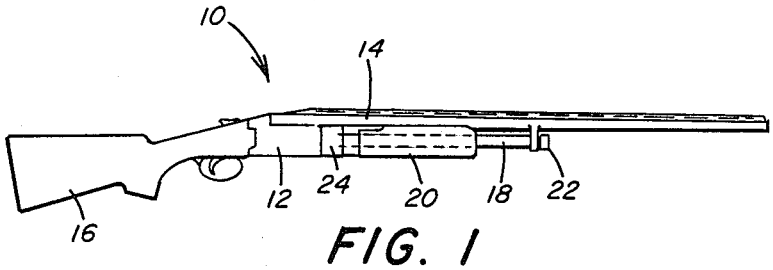
FIG. 1 is a schematic representation of a conventional pump action shotgun.

Referring to FIG. 1, there is illustrated a conventional pump action shotgun generally designated by the numeral 10 that includes a receiver or frame 12 and a barrel 14 extending forwardly of the receiver 12 and a stock 16 extending rearwardly from the receiver 12. Also extending forwardly from and secured to the receiver 12 beneath and parallel to the barrel 14 is a magazine tube 18. The magazine tube 18 is conventionally secured to the frame 12, as is well known in the art. A conventional wooden fore end 20 surrounds the magazine tube 18. A threaded cap 22 closes the outer end of the tube 18. A guide ring or sleeve 24 is positioned forwardly of the receiver 12 and circles the magazine tube 18 and is slidably movable on the tube 18 as the barrel 14 moves in recoil, upon discharge of the firearm.

Figure 2:
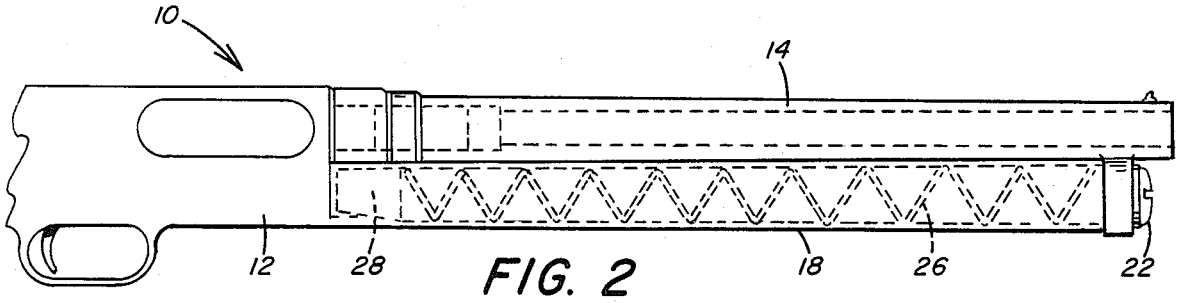
FIG. 2 is an enlarged, fragmentary, schematic view of a conventional shotgun, illustrating the conventional fore end removed and illustrating the magazine tube and internal spring therein.

The magazine tube 18 is illustrated in FIG. 2 with the conventional fore end 20 removed. The magazine tube 18 includes a conventional magazine spring 26 that abuts, at one end, a stop 28 positioned in the magazine tube 18 adjacent the receiver 12 and at the opposite end, the cap 22. The operation of the magazine tube 18, fore end 20 and magazine spring 26 to chamber the shell, eject the fired cartridge and to provide support for the shooter is well known in the art and will not be described in further detail.

Figure 3:
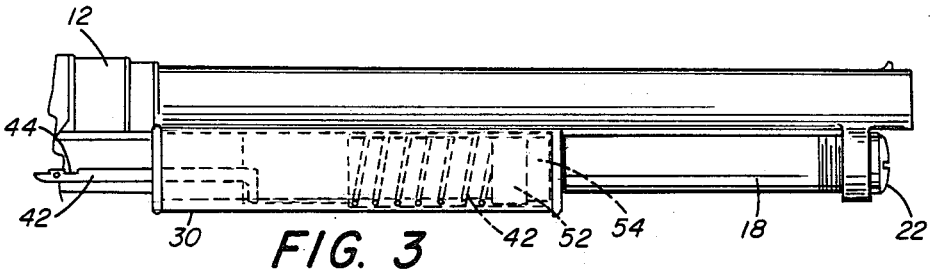
FIG. 3 is an enlarged fragmentary view of a recoil buffer for a firearm, in accordance with the present invention, illustrating a recoil spring positioned around the magazine tube, abutting at one end a fore end and at the opposite end a sleeve held in place by a spanner nut threadedly engaged to the magazine tube.
Figure 4:
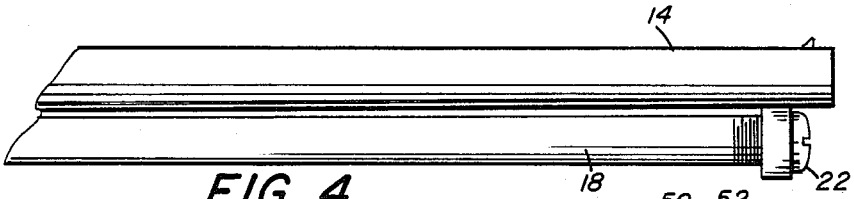
FIG. 4 is a fragmentary view, in side elevation, of the magazine tube with the fore end, recoil spring and spanner nut removed to illustrate the threaded portion of the magazine tube that receives the spanner nut.
Figure 5:
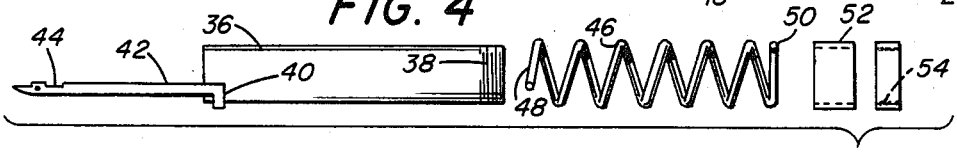
FIG. 5 is an exploded view, schematically illustrating the recoil spring, sleeve and spanner nut which are positioned on the magazine tube.
Figure 6:
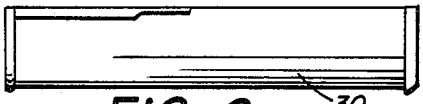
FIG. 6 is a view, in side elevation, of the fore end of the present invention, which replaces the conventional fore end of the firearm shown in FIG. 1.
Figure 7:
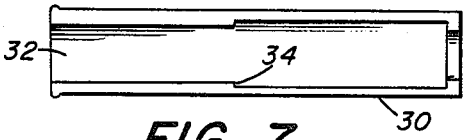
FIG. 7 is a top plan view of the fore end shown in FIG. 6.

In accordance with the present invention, as illustrated in detail in FIG. 3 and further in FIGS. 4–7, there is illustrated a light weight fore end 30 that is adapted to replace the conventional fore end 20 of the firearm 10 illustrated in FIG. 1. The fore end 30 is preferably fabricated of wood, aluminum or plastic material and has a cup-shaped configuration, as illustrated in FIGS. 6 and 7. With this arrangement, the fore end 30 has an internal channel 32 provided with a shoulder 34 positioned intermediate the end portions of the channel. The fore end 30 is positioned in surrounding relation with a fore end member, such as a tube 36. The fore end 30 is reciprocally movable on the tube 36. The fore end tube 36 has a tubular configuration so as to surround the magazine tube 18, as illustrated in FIG. 3. The fore end tube 36 has a threaded end portion 38 and an opposite end portion 40 to which is secured a pair of action slide bars 42 (one of which is illustrated in FIGS. 3 and 5).

A slide bar 42 is positioned on each side of the fore end tube 36 at the end portion 40. The slide bars 42 are suitably connected to the fore end tube end portion 40 at one end of the respective bars and an opposite end of each bar includes a slotted portion 44. The slotted portions 44 are inserted into grooves (not shown) of the receiver 12 in a well known manner to facilitate the slide action of the fore end tube 36 and connect the fore end tube 36 to the receiver 12.

The fore end tube 36 is positioned in channel 32 of the fore end 30. Surrounding the fore end tube 36 in the fore end 30 is a compression coil spring 46. The coil spring 46 has a first end portion 48 and a second end portion 50. The first end portion 48 abuts the fore end shoulder 34, as illustrated in FIG. 3. The second end portion 50 abuts a bushing 52 that surrounds the fore end tube 36 adjacent the threaded end 38. A spanner nut 54 is threaded onto the fore end tube end portion 38. The spanner nut 54 is threaded onto the end portion 38 of the fore end tube 36 to exert a preselected compression upon the coil spring 46.

In operation, when the shotgun 10 is fired, the rearward force generated is transmitted to the firer's hand and with the fore end 30 being positioned stationary in the firer's hand, the spring 46 is further compressed. Thus, the full force of the rearward movement normally associated with the recoil when the shotgun is fired and normally directed through the stock 16 upon the firer's shoulder is now absorbed by the spring 46 and the inertia of the fore end 30. The firer supports the shotgun 10 at the fore end 30, and the fore end 30 is movable forwardly against the compression of the spring 46. The firer exerts an inertia force upon the fore end 30 tending to maintain the fore end 30 stationary.

When the shotgun 10 is fired, the rearward recoil force is transmitted to the coil spring 46 within the fore end 30 which is supported by the firer's hand. The firer, by supporting the fore end 30, maintains the fore end 30 stationary against the compression of the spring 46. When the shotgun 10 is fired, the rearward recoil force which is normally generated is absorbed by the coil spring 46. Also, the fore end 30 being supported by the firer's hand has a stationary inertia force which acts to further resist the rearward recoil force. Thus, the full magnitude of the rearward recoil force is reduced by the action of the coil spring 46 to resist the rearward recoil force. Also, the stationary inertia force acting on the fore end 30 counteracts the rearward recoil force. The resultant effect is a substantially reduced rearward force acting on the fore end 30 to slightly, forwardly move the fore end 30 to further compress the coil spring 46. Consequently, a substantially buffered recoil force moves the shotgun 10 rearwardly so that the impact against the firer's shoulder is also buffered to the extent that the impact is insignificant and barely negligible to the shooter.

The advantage achieved by the present invention is that after prolonged shooting, particularly in trap and skeet competition, the firer does not experience shoulder soreness. This has the overall effect of improving the shooter's accuracy as a result of the reduced impact against the firer's shoulder associated with the recoil of the shotgun 10.

Figure 8:
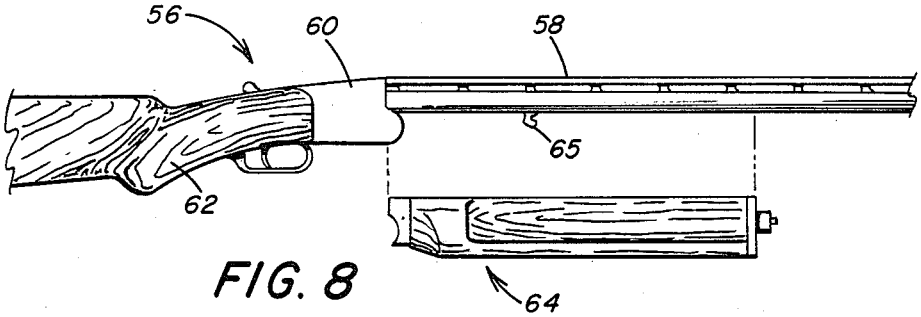
FIG. 8 is a schematic representation of a single action shotgun adaptable to use the recoil buffer of the present invention.
Figure 9:
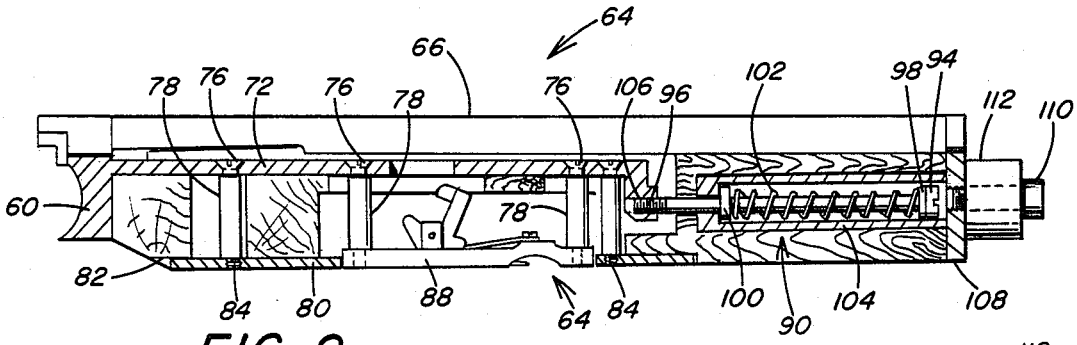
FIG. 9 is an enlarged, schematic, sectional view of the recoil buffer shown in FIG. 8 adaptable for use on a single action shotgun.
Figure 10:
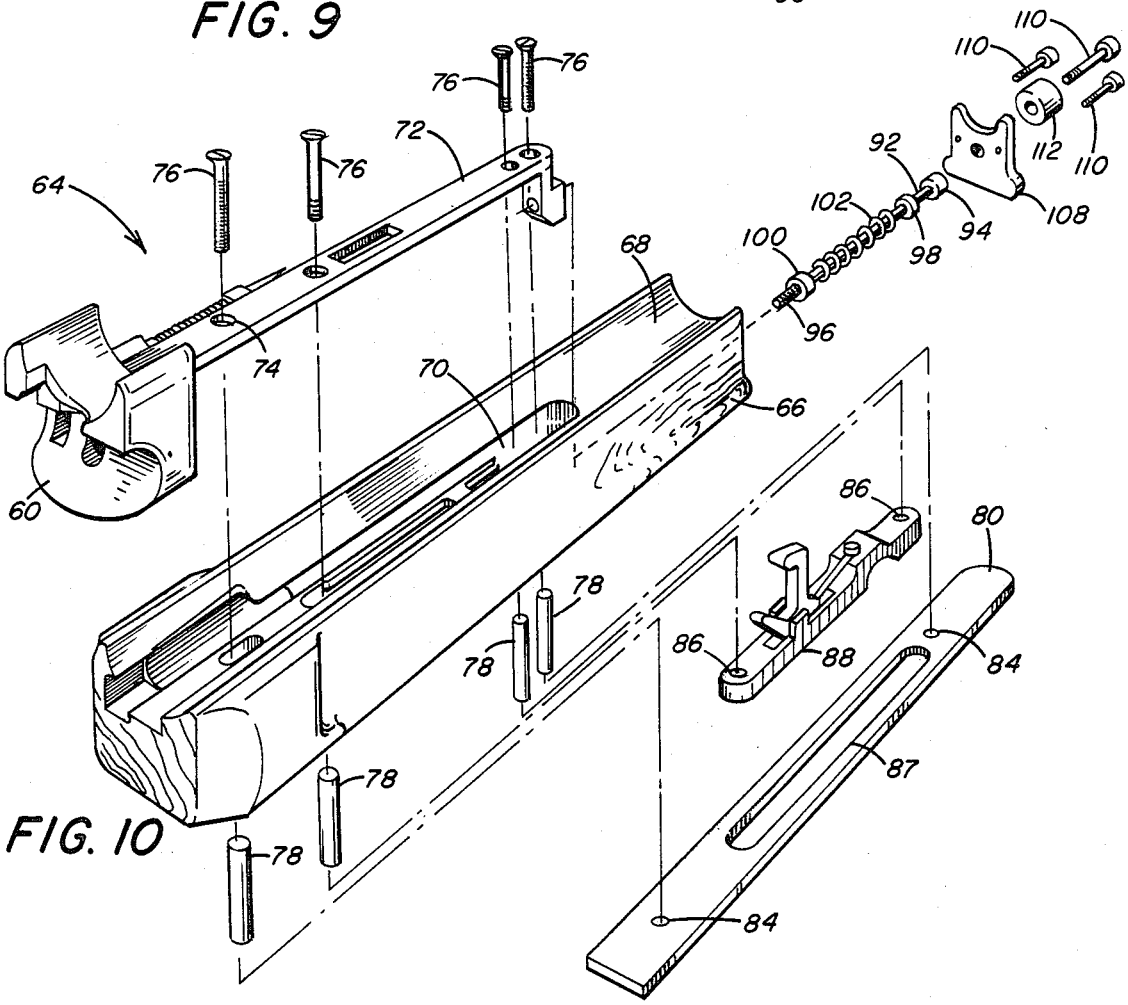
FIG. 10 is an enlarged, exploded view of the recoil buffer shown in FIG. 9.

Now referring to FIGS. 8–10, there is illustrated an additional embodiment of the present invention that is adaptable for use with a single action shotgun, generally designated by the numeral 56 in FIG. 8. The shotgun 56 includes a barrel 58 connected by a receiver 60 to a stock 62. A fore end generally designated by the numeral 64 in accordance with the present invention is releasably engageable with a hook 65 extending from the barrel 58 and is engaged at one end to the receiver 60.

The fore end 64 is illustrated in greater detail in FIGS. 9 and 10 and includes a light weight cup-shaped body portion 66 having a channel 68 with a recessed portion 70 therein. The recessed portion 70 is adapted to receive a fore end iron 72 that is connected at one end to the receiver 60. The fore end iron 72, in its assembled position within the channel 68 of the fore end body portion 66 seats within the recessed portion 70 and the receiver 60 abuts the end of the fore end body portion 66. The fore end iron 72 includes a plurality of bores 74 through which extend threaded members 76. The threaded members 76 extend through tubular spacers 78 that are supported on a guide plate 80 received within a lower recess 82 (as shown in FIG. 9) of the fore end body portion 66. The guide plate 80 is connected to the fore end iron 72 by threaded connection of a first pair of the members 76 in the threaded bores 84 of the guide plate 80 and by threaded connection of a second pair of the members 76 in the threaded bores 86 of the fore end iron catch 88 as illustrated in FIGS. 9 and 10.

The fore end iron 72 and guide plate 80 are maintained in preselected, spaced position by the tubular members 78. Also, as illustrated in FIGS. 9 and 10, the guide plate 80 includes a longitudinal slot 87 in which is received a fore end iron catch 88. The fore end iron catch 88 is engageable with the hook 65 extending from the barrel 58.

Positioned forwardly of the fore end body portion 66, as shown in FIG. 9, is a recoil buffer generally designated by the numeral 90 that includes a fore end member, such as a rod 92, having an enlarged end portion 94 and a threaded end portion 96 with spacers 98 and 100 positioned adjacent thereto respectively. Positioned between the spacers 98 and 100 is a coil spring 102. The rod 92 extend through a fore end tube 104 positioned at the forward end of the fore end body portion 66. The threaded end 96 of rod 92 is threadedly received within a threaded bore 106 of the fore end iron 72. With this arrangement, the fore end member or rod 92 is connected to the receiver 60.

The rod 92 is threadedly advanced in the fore end bore 106 so that the spacer 100 abuts the closed end of the tube 104 to compress the spring 102 between the spacers 98 and 100. The open end of the fore end body portion 66 is closed by a plate 108 engaged to the fore end 66 by threaded members 110 extending through an auxillary weight 112 and the plate 108 into the fore end body portion 66.

With the above-described arrangement, as with the arrangement illustrated in FIGS. 3–7 and described above, when the shotgun is fired, the rearward force generated by the gun is transmitted to the firer's hand which exerts an inertia force on the fore end body portion 66 tending to maintain the fore end body portion 66 at rest. The fore end body portion 66 moves incrementally forwardly to further cmpress the spring 102. The spring 102 absorbs the recoil force so that the resultant effect is only slight rearward movement of the shotgun stock against the firer's shoulder. This buffered rearward movement presents only a fraction of the rearward movement or shock force normally encountered in firing a shotgun without the benefit of the present invention.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A firearm recoil reducing device comprising, a firearm having a receiver, a fore end member positioned forwardly of said receiver, means for connecting said fore end member to said receiver, a movable fore end adapted to receive said fore end member, said movable fore end having an internal shoulder, a compression coil spring positioned in said movable fore end in surrounding relation with said fore end member, said coil spring having a first end and a second end, said coil spring first end exerting a force on said fore end internal shoulder, a spanner nut releasably engageable with the end of said fore end member adjacent said coil spring second end portion, and said spanner nut movable to a predetermined position on said fore end member to compress said coil spring on said fore end member between said fore end internal shoulder and said spanner nut such that when the firearm is discharged said movable fore end remains stationary against the compression of said coil spring and said coil spring compresses further to reduce the recoil force directed toward said receiver.

2. A firearm recoil reducing device as set forth in claim 1 which includes, a magazine tube secured to and extending forwardly of said receiver, said fore end member including a fore end tube surrounding said magazine tube, means for slidably connecting said fore end tube to said receiver, and said coil spring surrounding said magazine tube.

3. A firearm recoil reducing device as set forth in claim 2 which includes, said movable fore end surrounding said coil spring on said fore end tube surrounding said magazine tube, said spanner nut being fixed on said fore end tube adjacent said coil spring second end portion, and said coil spring being compressed on said magazine tube between said spanner nut and fore end internal shoulder.

4. A firearm recoil reducing device as set forth in claim 3 which includes, a bushing surrounding said fore end tube and positioned between said coil spring second end portion and said spanner nut, and said spanner nut being threadedly connected to said fore end tube to maintain said bushing in compressive relation with said coil spring second end portion to maintain said coil spring first end portion compressed against said fore end internal shoulder.

5. A firearm recoil reducing device as set forth in claim 1 in which, said fore end member is movable toward said receiver upon discharge of the firearm to compress said coil spring between said spanner nut and said fore end internal shoulder to absorb the recoil force and reduce the magnitude of the recoil force applied to said receiver.

6. A firearm recoil reducing device as set forth in claim 1 in which, said movable fore end has an elongated cup-shaped configuration adapted to surround said fore end member, said movable fore end having an internal channel extending the length of said movable fore end, said internal shoulder positioned within said internal channel, and said coil spring first end exerting a force on said internal shoulder to maintain said movable fore end positioned on said fore end member.

7. A firearm recoil reducing device as set forth in claim 1 which includes, means extending between said receiver and fore end member for connecting said fore end member to said receiver.

8. A firearm recoil reducing device comprising, a firearm having a receiver, a fore end member positioned forwardly of said receiver, means for connecting said fore end member to said receiver, said means for connecting said receiver to said fore end member includes a fore end iron having a first end portion connected to said receiver and a second end portion connected to said fore end member, a movable fore end adapted to receive said fore end member, said movable fore end having an internal shoulder, said fore end member having one end portion threadedly connected to said movable fore end internal shoulder and an opposite end portion extending from said movable fore end internal shoulder, a compression coil spring positioned in said movable fore end in surrounding relation with said fore end member, said coil spring having a first end and a second end, said coil spring first and second ends being compressed on said fore end member between said movable fore end internal shoulder and said fore end member opposite end portion, and said fore end member opposite end portion being advanced to a predetermined position spaced from said movable fore end internal shoulder to compress said coil spring on said fore end member such that when said firearm is discharged said movable fore end remains stationary against the compression of said coil spring and said coil spring compresses further to reduce the recoil force directed toward said receiver.

9. A firearm recoil reducing device as set forth in claim 8 which includes, means for connecting said fore end iron to said movable fore end to stabilize said fore end iron relative to said receiver.

10. A firearm recoil reducing device as set forth in claim 8 which includes, a fore end tube retained in a fixed position within said movable fore end, said fore end member including a rod extending through said fore end tube, said fore end tube having an end portion abutting said fore end internal shoulder, said rod having a first end portion extending through said fore end tube end portion and a second end portion, and said coil spring positioned on said rod and being compressed between said fore end tube end portion and said rod second end portion.

11. A method for buffering the recoil of a firearm comprising the steps of, positioning a fore end member forwardly of a receiver of a firearm, connecting the fore end member to the receiver, positioning the fore end member in a movable fore end, supporting the fore end for reciprocal movement relative to the receiver, exerting a preselected force by biasing means upon the fore end, moving the fore end forwardly to a stationary position to compress the biasing means prior to discharge of the firearm, discharging the firearm to generate a rearwardly directed recoil force upon the receiver, exerting a force upon the fore end tending to maintain the fore end stationary in response to the recoil force, and transmitting the recoil force to the biasing means and the stationary fore end to resist the recoil force and reduce the magnitude of the recoil force applied to the receiver.

12. A method for buffering the recoil of a firearm as set forth in claim 11 which includes, threading a spanner nut onto the fore end member, and advancing the spanner nut to a preselected position on the fore end member to exert a preselected compression upon the biasing means.

13. A method for buffering the recoil of a firearm as set forth in claim 11 which includes, supporting the fore end in a firer's hand to maintain the fore end stationary against the compression of the biasing means, and applying an inertia force by the firer's hand to the fore end to maintain the fore end stationary.

14. A method for buffering the recoil of a firearm as set forth in claim 13 which includes, resisting the rearwardly directed recoil force by the inertia force applied to the fore end.

15. A method for buffering the recoil of a firearm as set forth in claim 11 which includes, adjustably connecting the fore end member to the receiver, positioning the biasing means on the fore end member, compressing the biasing means between the fore end member and the receiver, and adjusting the position of the fore end member on the receiver to exert a preselected compression on the biasing means.

* * * * *